US010831132B2

(12) United States Patent
Suzuki et al.

(10) Patent No.: US 10,831,132 B2
(45) Date of Patent: Nov. 10, 2020

(54) TRANSFER DEVICE AND IMAGE FORMING APPARATUS INCORPORATING SAME

(71) Applicants: Takahiro Suzuki, Kanagawa (JP); Yuuji Wada, Kanagawa (JP); Naoto Kochi, Tokyo (JP); Shinya Tanaka, Kanagawa (JP)

(72) Inventors: Takahiro Suzuki, Kanagawa (JP); Yuuji Wada, Kanagawa (JP); Naoto Kochi, Tokyo (JP); Shinya Tanaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/248,939

(22) Filed: Jan. 16, 2019

(65) Prior Publication Data

US 2019/0243288 A1 Aug. 8, 2019

(30) Foreign Application Priority Data

Feb. 6, 2018 (JP) ..... 2018-019480

(51) Int. Cl.
*G03G 15/20* (2006.01)
*G03G 15/16* (2006.01)

(52) U.S. Cl.
CPC ..... *G03G 15/1605* (2013.01); *G03G 15/1615* (2013.01); *G03G 15/1665* (2013.01)

(58) Field of Classification Search
CPC ..... G03G 15/1605; G03G 15/2028; G03G 15/2032; G03G 2215/1614; G03G 2215/1661; G03G 2215/738; G03G 2215/751; G03G 2215/59; G03G 2215/19
USPC ..... 399/66, 107, 110, 121, 297, 302, 308
See application file for complete search history.

(56) References Cited

U.S. PATENT DOCUMENTS

| | | | | |
|---|---|---|---|---|
| 8,433,221 | B2 * | 4/2013 | Minbe | G03G 15/2032 399/121 |
| 9,256,165 | B2 * | 2/2016 | Takahashi | G03G 15/1605 |
| 9,360,807 | B2 * | 6/2016 | Kogure | G03G 15/161 |
| 2012/0121293 | A1 | 5/2012 | Mimbu et al. | |

(Continued)

FOREIGN PATENT DOCUMENTS

| | | |
|---|---|---|
| JP | 2010-139603 | 6/2010 |
| JP | 2013-250353 | 12/2013 |
| JP | 2016-110013 | 6/2016 |

OTHER PUBLICATIONS

Extended European Search Report dated Jul. 1, 2019.

*Primary Examiner* — Hoan H Tran
(74) *Attorney, Agent, or Firm* — Harness, Dickey & Pierce, P.L.C.

(57) ABSTRACT

A transfer device includes an intermediate transfer belt configured to bear a toner image and rotate, a transferor configured to contact the intermediate transfer belt via a recording medium and form a transfer nip, a guide configured to guide the recording medium conveyed to the transfer nip, and a pressure reducing device. The intermediate transfer belt is shaped as an endless belt. The pressure reducing device is configured to reduce pressure-contact force of the transferor against the intermediate transfer belt as the recording medium advances in the transfer nip. Therefore, a trailing end of the recording medium does not move toward the intermediate transfer belt when the trailing end of the recording medium has passed the guide.

13 Claims, 3 Drawing Sheets

(56) References Cited

U.S. PATENT DOCUMENTS

| | | | | |
|---|---|---|---|---|
| 2014/0334847 | A1 | 11/2014 | Takahashi et al. | |
| 2016/0306317 | A1 | 10/2016 | Wada et al. | |
| 2017/0235257 | A1 | 8/2017 | Kochi et al. | |
| 2017/0235258 | A1 | 8/2017 | Wada et al. | |
| 2018/0164720 | A1* | 6/2018 | Nagata ..... | G03G 15/1615 |

* cited by examiner

| SHEET THICKNESS | PRESSURE-CONTACT FORCE (%) |
|---|---|
| 1 | 100 |
| 2 | 100 |
| 3 | 100 |
| 4 | 100 |
| 5 | 90 |
| 6 | 80 |
| 7 | 70 |
| 8 | 60 |
| 9 | 50 |

TRANSFER DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2018-019480, filed on Feb. 6, 2018, in the Japan Patent Office, the entire disclosure of which is hereby incorporated by reference herein.

BACKGROUND

Technical Field

This disclosure generally relates to an image forming apparatus such as a copier, a printer, a facsimile machine, or a multifunction peripheral (MFP) having at least two of copying, printing, facsimile transmission, plotting, and scanning capabilities, and a transfer device incorporated therein.

Description of the Related Art

There is known an electrophotographic image forming apparatus including an intermediate transfer belt, which is a rotatable endless belt and looped around a plurality of rollers, such as a driving roller, a driven roller, a secondary transfer backup roller, and the like. Image formation is performed as follows. A toner image is formed on a photoconductor drum and primarily transferred onto a surface of the intermediate transfer belt. Subsequently, the toner image on the intermediate transfer belt is secondarily transferred onto a recording medium.

In the image forming apparatus, a secondary transfer roller is pressed against the secondary transfer backup roller via the intermediate transfer belt. A contact portion between the secondary transfer backup roller and the secondary transfer roller is referred to as a secondary transfer nip. When the toner image on the intermediate transfer belt passes through the secondary transfer nip, the recording medium is passed through between the intermediate transfer belt and the secondary transfer roller to transfer the toner image onto the recording medium, thereby performing image formation.

SUMMARY

According to embodiments of the present disclosure, an improved transfer device includes an intermediate transfer belt configured to bear a toner image and rotate, a transferor configured to contact the intermediate transfer belt via a recording medium and form a transfer nip, a guide configured to guide the recording medium conveyed to the transfer nip, and a pressure reducing device. The intermediate transfer belt is shaped as an endless belt. The pressure reducing device is configured to reduce pressure-contact force of the transferor against the intermediate transfer belt as the recording medium advances in the transfer nip. Therefore, a trailing end of the recording medium does not move toward the intermediate transfer belt when the trailing end of the recording medium has passed the guide.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
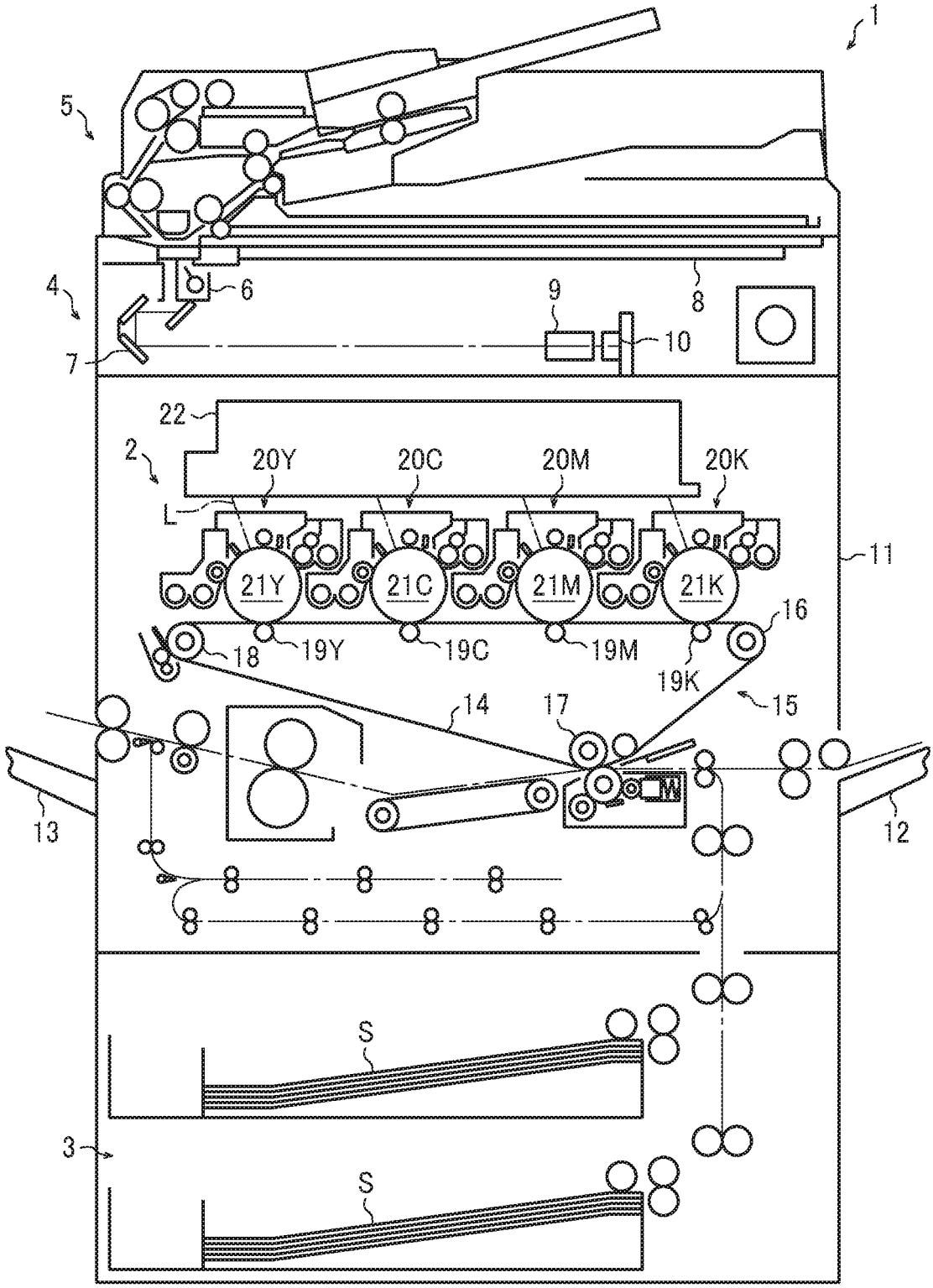
FIG. 1 is a schematic view illustrating a configuration of a copier according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

A description is given of an image forming apparatus according to an embodiment of the present disclosure.

FIG. 1 is a schematic view illustrating a configuration of a copier 1 as an electrophotographic image forming apparatus according to the present embodiment. The copier 1 includes an image forming device 2 to form an image on a transfer sheet S as a recording medium, a sheet feeder 3 to feed the transfer sheet S to the image forming device 2, an image reader 4 to read an image of an original document, and an automatic document feeder (ADF) 5 to automatically feed the original document to the image reader 4.

The image reader 4 includes a first moving unit 6 including an original document light source and at least one mirror, and a second moving unit 7 including multiple reflection mirrors. Along with reciprocating motions of the first moving unit 6 and the second moving unit 7, the image of the original document placed on an exposure glass 8 is scanned. Scanning light transmitted from the second moving unit 7 is collected, by an imaging lens 9, on an image forming surface of a reading sensor 10 disposed behind the imaging lens 9. Then, the reading sensor 10 reads the collected light as an image signal.

A bypass feeder 12 is disposed on one side face of an apparatus body 11 of the copier 1, and an output tray 13 is disposed on the other side face of the apparatus body 11. The transfer sheets S to be fed are stacked on the bypass feeder 12, and the transfer sheets S ejected from the apparatus body 11 are stacked on the output tray 13.

The image forming device 2 includes an intermediate transfer belt 14 having an endless belt-shape as an image bearer, a transfer unit 15 as a transfer device including multiple rollers around which the intermediate transfer belt 14 is entrained. The intermediate transfer belt 14 is entrained around a driving roller 16, a secondary transfer backup roller 17, a driven roller 18, and four primary transfer rollers 19Y, 19C, 19M, and 19K. As the driving roller 16 is rotated clockwise by a driver, the intermediate transfer belt 14 receives driving force from the driving roller 16 to be rotated clockwise in FIG. 1.

Note that suffixes Y, C, M, and K attached to the reference numerals of the primary transfer rollers 19Y, 19C, 19M, and 19K indicate that components indicated thereby are used for forming yellow, cyan, magenta, and black images, respectively. The suffixes Y, C, M, and K may be omitted when color discrimination is not necessary, or when the components are collectively referred to. These suffixes are also applicable to other components to be described below.

The intermediate transfer belt 14 is greatly curved at positions of the driving roller 16, the secondary transfer backup roller 17, and the driven roller 18 around which the intermediate transfer belt 14 is wound. Consequently, the intermediate transfer belt 14 forms an inverted triangle shape with a base being vertically upward in appearance. An upper side (the base of the inverted triangle) of the intermediate transfer belt 14 is horizontally stretched between the driving roller 16 and the driven roller 18. Above the upper side (the base of the inverted triangle), process units 20Y, 20C, 20M, and 20K (hereinafter, also collectively referred to as process units 20) including photoconductor drums 21Y, 21C, 21M, and 21K are horizontally aligned in parallel. In the present embodiment, the process units 20 are identical in configuration, differing only in color of toner employed. In another embodiment, the process units 20 are different in configuration corresponding to the color of the toner employed.

An optical writing unit 22 is disposed above four process units 20. The optical writing unit 22 includes four semiconductor lasers driven by a laser controller to emit four writing light beams (laser beams) L based on image data of the original document read by the image reader 4. The respective photoconductor drums 21 are scanned with corresponding writing light beams (laser beams) L in the dark to form electrostatic latent images on the surfaces of the photoconductor drums 21.

According to the present embodiment, the optical writing unit 22 further includes a polygon mirror that deflects the writing light beam (laser beam) L from the semiconductor laser, a reflecting mirror that reflects the writing light beam (laser beam) L, and an optical lens through which the writing light beam (laser beam) L passes. In another embodiment, for example, an optical writing unit includes a light emitting diode (LED) array for light scanning instead of the above-described configuration.

The photoconductor drums 21 contact the stretched upper side of the intermediate transfer belt 14 driven by the driving roller 16, and the primary transfer rollers 19 contact the back surface of the intermediate transfer belt 14, thereby forming primary transfer nips between the respective photoconductor drums 21 and the corresponding primary transfer rollers 19. A primary transfer power source applies respective primary transfer biases opposite to toner in polarity to the corresponding primary transfer rollers 19. Accordingly, a primary transfer electric field that electrostatically transfers the toner image of each color formed on the photoconductor drum 21 onto the intermediate transfer belt 14 is generated at each of the primary transfer nips for yellow, cyan, magenta, and black.

When the yellow, magenta, cyan, and black toner images formed on the photoconductor drums 21 enter the primary transfer nips along with rotation of the photoconductor drums 21, respectively, the respective toner images are primarily transferred and sequentially superimposed onto the intermediate transfer belt 14, due to the primary transfer electric field and a nip pressure. Thus, a multicolor toner image in which four color toner images are superimposed is formed on a front surface (outer circumference face of the loop) of the intermediate transfer belt 14. In the present embodiment, the primary transfer rollers 19 are employed as primary transfer devices. Alternatively, a conductive brush to which the primary transfer bias is applied, a non-contact corona charger, or the like can be adopted instead of the primary transfer roller 19 as the primary transfer device.

Figure 2:
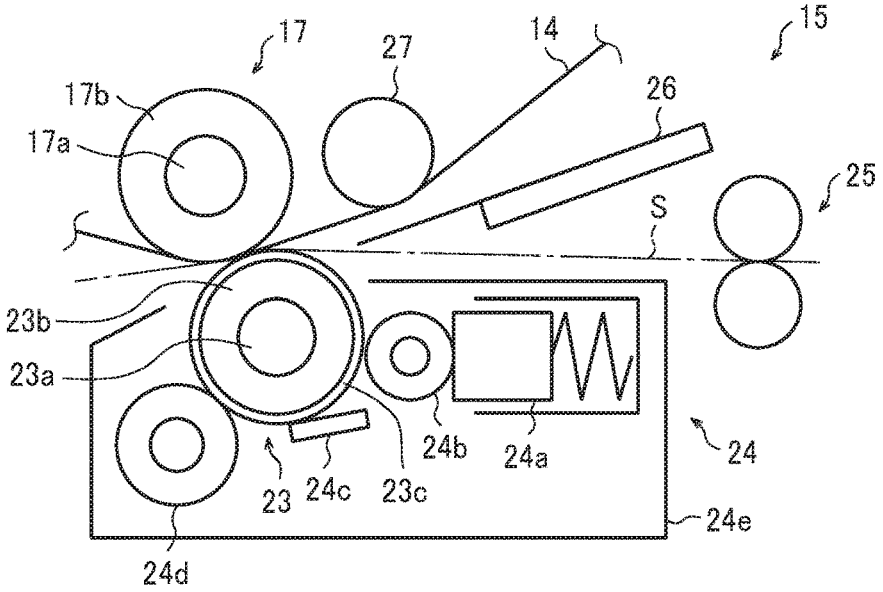
FIG. 2 is a schematic view illustrating a configuration of a transfer unit according to an embodiment of the present disclosure.

FIG. 2 illustrates a configuration of a part of the transfer unit 15 near the secondary transfer backup roller 17. The secondary transfer backup roller 17 includes a cylindrical core 17*a* made of metal, and a conductive elastic layer 17*b* that covers the outer circumference of the core 17*a*. A secondary transfer power source applies a secondary transfer bias with the same polarity of toner as a transfer bias to the secondary transfer backup roller 17.

A secondary transfer roller 23 as a transferor is disposed opposite the secondary transfer backup roller 17 via the intermediate transfer belt 14 to secondarily transfer the multicolor toner image on the intermediate transfer belt 14 to the transfer sheet S. The secondary transfer roller 23 includes a cylindrical core 23*a* made of metal, a conductive elastic layer 23*b* that covers the outer circumference of the core 23*a*, and a surface layer 23*c* that covers the outer circumference of the elastic layer 23*b*. The surface layer 23*c* is made of conductive resin. The secondary transfer roller 23 is grounded.

The secondary transfer roller 23 is pressed against the secondary transfer backup roller 17 via the intermediate transfer belt 14 under a predetermined pressure, thereby forming the secondary transfer nip as a transfer nip.

A dust prevention device 24 is disposed around the secondary transfer roller 23 to prevent paper dust from adhering to the surface layer 23*c*. The dust prevention device 24 includes a lubricant 24*a*, an application roller 24*b*, such as a brush roller, to apply the lubricant 24*a* to the surface layer 23*c*, a blade 24*c* and a brush roller 24*d* in contact with the surface layer 23*c* to remove paper dust, and a casing 24*e* to accommodate the above-described components. A registration roller pair 25 is disposed upstream from the dust prevention device 24 in a direction of conveyance of the transfer sheet S. The registration roller pair 25 temporarily stops the transfer sheet S and then feeds the transfer sheet S to the secondary transfer nip.

A conveyance guide 26 as a guide is disposed upstream from the secondary transfer nip in the direction of conveyance of the transfer sheet S. The conveyance guide 26 guides the transfer sheet S to the secondary transfer nip so as to prevent the transfer sheet S from contacting the toner image on a portion of the intermediate transfer belt 14 upstream from the secondary transfer nip in the direction of conveyance of the transfer sheet S for a long time.

As the secondary transfer bias is applied to the secondary transfer backup roller 17, a secondary transfer current flows between the secondary transfer backup roller 17 and the secondary transfer roller 23 via the intermediate transfer belt 14. The secondary transfer current mainly flows through a route connecting axes of the secondary transfer backup roller 17 and the secondary transfer roller 23. Accordingly, the toner image is secondarily transferred from the intermediate transfer belt 14 to the transfer sheet S at a position between axes of the secondary transfer backup roller 17 and the secondary transfer roller 23. If a gap is formed between the surface of the intermediate transfer belt 14 and the secondary transfer roller 23 at a position slightly upstream from the position between the axes in the direction of conveyance of the transfer sheet S, discharge occurs in the gap. As a result, toner forming the toner image that arrives at the gap immediately before entering the secondary transfer nip scatters, causing image dust. Two types of secondary transfer biases applied to the secondary transfer backup roller 17 (i.e., a direct current and an alternating current) can be properly used according to desired images.

To prevent the above-described inconvenience from being caused, the intermediate transfer belt 14 is forcibly wound around the secondary transfer roller 23 at a position upstream from the position between the axes in the direction of conveyance of the transfer sheet S so that the gap is not formed at the position upstream from the position between the axes in the direction of conveyance of the transfer sheet S. A push-down roller 27 is disposed in the loop of the intermediate transfer belt 14 and upstream from the secondary transfer backup roller 17 in a direction of rotation of the intermediate transfer belt 14, to form the winding of the intermediate transfer belt 14 around the secondary transfer roller 23. The push-down roller 27 pushes the intermediate transfer belt 14 downward from the inside of the loop of the intermediate transfer belt 14 toward the secondary transfer roller 23 to force the intermediate transfer belt 14 to wind around the secondary transfer roller 23. The winding of the intermediate transfer belt 14 around the secondary transfer roller 23 forms a contact portion (i.e., a pre-nip) between the intermediate transfer belt 14 and the secondary transfer roller 23 upstream from the secondary transfer nip in the direction of rotation of the intermediate transfer belt 14. As a result, a total secondary transfer nip composed of the secondary transfer nip and the pre-nip spreads toward the upstream side from the secondary transfer nip. The pre-nip causes the gap to be formed away from a position where the secondary transfer bias does not affect, thereby effectively minimizing image dust.

A description is given of a mechanism of the white voids on the trailing end of the transfer sheet S after the trailing end has passed through the conveyance guide 26. The mechanism to be described is a problem to be solved in the present disclosure.

Figure 3:
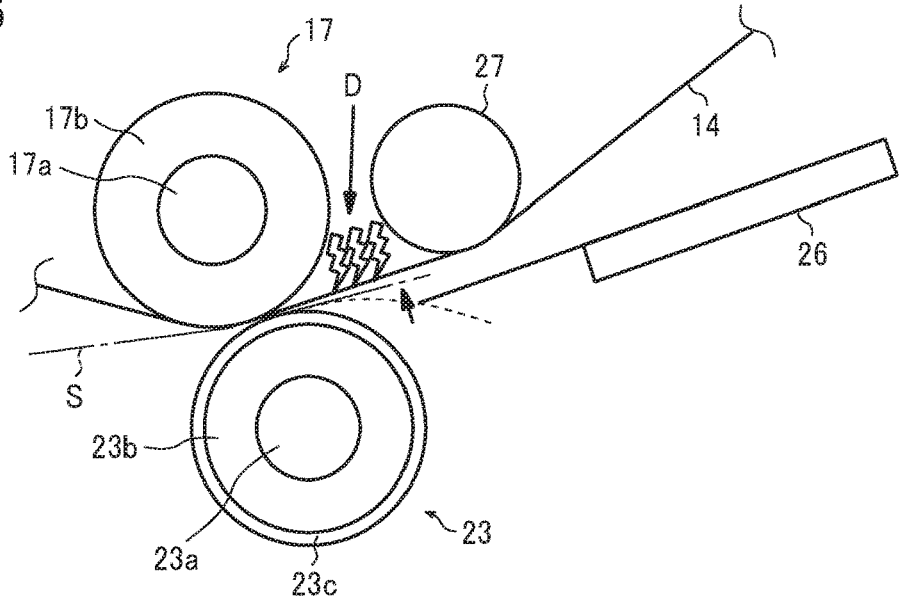
FIG. 3 is a schematic view illustrating inconvenience in a comparative transfer unit.

In FIG. 3, the trailing end of the transfer sheet S abruptly approaches (moves toward) or contacts the intermediate transfer belt 14 after passing through the conveyance guide 26, whereby an impact and discharge indicated by arrow D in FIG. 3 are caused. Toner on the intermediate transfer belt 14 scatters due to the impact or discharge, causing the white voids on the trailing end of the transfer sheet S. The white voids on the trailing end of the transfer sheet S occurs in both cases in which a direct current and an alternating current are applied to the secondary transfer nip. However, in the case of alternating current, the effect of an electric field on toner scattering is greater than in the case of direct current. Therefore, the white voids on the trailing end of the transfer sheet S is more likely to occur in the case of alternating current.

Figure 4:
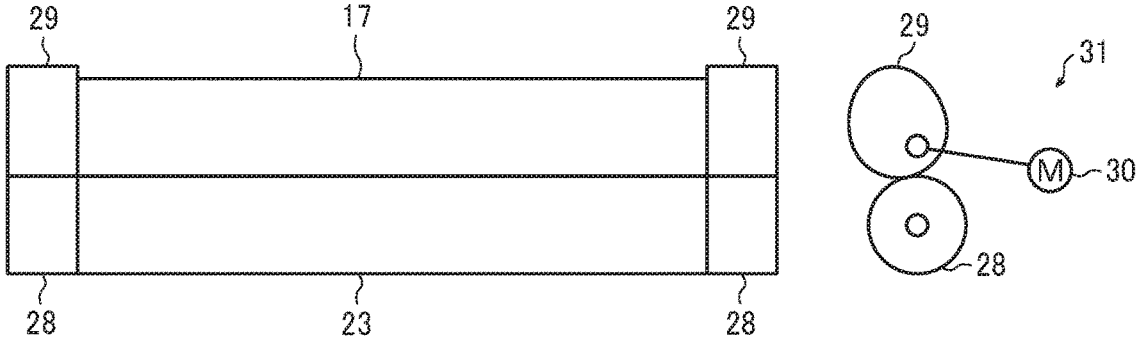
FIG. 4 is a schematic view illustrating a configuration of a pressure reducing device according to an embodiment of the present disclosure.

FIG. 4 illustrates a pressure reducing device 31 according to the present embodiment to prevent the above-described white voids from occurring on the trailing end of the transfer sheet S. In FIG. 4, bearings 28 are rotatably attached to both ends of the secondary transfer roller 23 in the axial direction of the secondary transfer roller 23. Cams 29 having an oval shape are attached to both ends of the secondary transfer backup roller 17 in the axial direction of the secondary transfer backup roller 17. The secondary transfer roller 23 is swingably supported by the apparatus body 11 and pressed against the secondary transfer backup roller 17 by biasing force of a biasing member. A stepping motor 30 attached to the apparatus body 11 rotates the cams 29 by a predetermined angle.

Figures 5, 6:
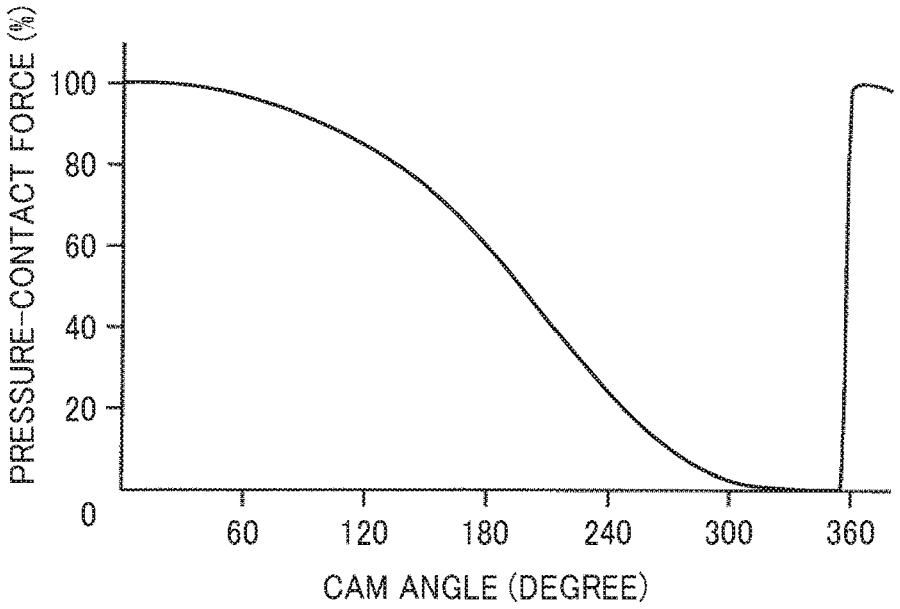
FIG. 5 is a graph illustrating a cam curve of a cam according to an embodiment of the present disclosure.
FIG. 6 is a table illustrating a relation between a sheet thickness and pressure-contact force.

The cam 29 has a large radius portion and a small radius portion. When the small radius portion of the cam 29 is opposed to the bearing 28, clearance is formed between the cam 29 and the bearing 28, and the secondary transfer roller 23 is pressed against the secondary transfer backup roller 17 at the maximum pressure of all biasing force by the biasing member. A degree of pressure-contact between the secondary transfer roller 23 and the secondary transfer backup roller 17 varies with rotation angle of the cam 29. The pressure reducing device 31 includes the bearings 28, the cams 29, and the stepping motor 30. FIG. 5 illustrates a cam curve of the cam 29.

As illustrated in FIG. 5, at a basic position at which the small radius portion of the cam 29 is opposed to the bearing 28 (i.e., 0 degree), secondary transfer pressure-contact force is 100% (60 N in the present embodiment). The cam 29 is designed so that the pressure-contact force is, for example, 95% (57 N) when the cam rotates by 60 degrees; 60% (36 N) when 180 degrees; and 25% (15 N) when 240 degrees.

In the present embodiment, the secondary transfer pressure-contact force is set to about 60 N at the secondary transfer nip, but a solid image can be transferred onto the transfer sheet S even when the secondary transfer pressure-contact force is about 20 N.

A description is given of an operation of the transfer unit 15 according to the present embodiment based on the above-described configuration.

An operation of the copier 1 is described in the case of standard paper normally used in the copier 1 as the transfer sheet S. In this case, the pressure reducing device 31 does not operate, and normal image formation is performed as usual.

The image reader 4 reads image data of the original document and transmits the image data from the reading sensor 10 to the optical writing unit 22. The optical writing unit 22 scans and exposes the respective photoconductor drums 21 based on the image data transmitted to the optical writing unit 22.

In the process unit 20K, the photoconductor drum 21K is driven and rotated, and the charging device uniformly charges the surface of the photoconductor drum 21K. The optical writing unit 22 irradiates the charged surface of the photoconductor drum 21K with the writing light beam L to form an electrostatic latent image for black. The electrostatic latent image is developed with black toner by a developing device into a black toner image. The black toner image formed on the photoconductor drum 21K is conveyed and primarily transferred onto the intermediate transfer belt 14 by the primary transfer roller 19K.

In the other process units 20Y, 20C, and 20M, similar processes of a series of image formation to the process unit 20K is performed, and a magenta toner image, a cyan toner image, and a yellow toner image are formed on the photoconductor drums 21Y, 21M, and 21C, respectively. The respective toner images on the photoconductor drums 21 are sequentially and primarily transferred to the intermediate transfer belt 14, thereby forming a multicolor toner image on the intermediate transfer belt 14.

The sheet feeder 3 feeds the topmost transfer sheet S of the stack of the transfer sheets S accommodated in the sheet feeder 3, and the registration roller pair 25 temporarily stops the transfer sheet S fed from the sheet feeder 3. The registration roller pair 25 feeds the transfer sheet S to the secondary transfer nip in accordance with the timing when the multicolor toner image on the intermediate transfer belt 14 arrives at the secondary transfer nip of the transfer unit 15.

The multicolor toner image on the intermediate transfer belt 14 is collectively transferred to the transfer sheet S fed from the registration roller pair 25 under the pressure-contact force and the secondary transfer bias at the secondary transfer nip at which the secondary transfer roller 23 is pressed against the secondary transfer backup roller 17 via the intermediate transfer belt 14. At that time, since the transfer sheet S is the standard paper, the pressure reducing device 31 does not reduce the secondary transfer pressure-contact force, and the cam 29 is in the basic position of 0 degree.

In the case of the standard paper as the transfer sheet S, the trailing end of the transfer sheet S does not abruptly approach the intermediate transfer belt 14 differently from what has been described with reference to FIG. 3 due to low stiffness of the standard paper. Therefore, the white void on the trailing end of the transfer sheet S does not occur. The transfer sheet S onto which the multicolor toner image is secondarily transferred is conveyed to a fixing device by a conveyance belt. The multicolor toner image is fixed on the transfer sheet S under the heat and pressure of the fixing device. Then, transfer sheet S is ejected to the outside of the apparatus body 11 and stacked on the output tray 13.

Next, in the case of a thicker sheet than the standard paper as the transfer sheet S, an operation of the copier 1 is described below. In this case, the pressure reducing device 31 operates, and the secondary transfer pressure-contact force at the secondary transfer nip is reduced.

Similarly to the above-described operation, the multicolor toner image is formed on the intermediate transfer belt 14, and is collectively and secondarily transferred onto the transfer sheet S fed from the registration roller pair 25.

In the secondary transfer process described above, the stepping motor 30 rotates the cam 29 by a predetermined angle after a predetermined time has elapsed since a leading end of the transfer sheet S enters the secondary transfer nip and before the trailing end of the transfer sheet S has passed through the registration roller pair 25. As illustrated in FIG. 6, the rotation angle of the cam 29 is related to sheet thickness of the transfer sheet S used in the image forming apparatus and adjusted so that the secondary transfer pressure-contact force becomes 50 to 100% in multiple stages according to the sheet thickness of the transfer sheet S used.

The external force acting on the transfer sheet S in the secondary transfer process is reduced by the pressure reducing device 31. Therefore, movement of the transfer sheet S as described with reference to FIG. 3 is prevented, that is, the trailing end of the transfer sheet S does not abruptly approach or contact the intermediate transfer belt 14 after passing through the conveyance guide 26. As a result, occurrence of the white voids on the trailing end of the transfer sheet S is effectively prevented.

In the secondary transfer process described above, the pressure reducing device 31 reduces the secondary transfer pressure-contact force after the transfer sheet S has entered the secondary transfer nip. Even when the secondary transfer pressure-contact force is 50% of the case in which the cam 29 is in the basic position as described above, problems on image output do not occur, and a desired image can be obtained.

The timing of reducing pressure by the pressure reducing device 31 is appropriately determined by experiments carried out according to thickness or material of the transfer sheet S used.

In the present embodiment, two types of secondary transfer biases applied to the secondary transfer backup roller 17 (i.e., a direct current and an alternating current) can be properly used according to desired images. Motion of toner is different between direct current and alternating current. The pressure-contact force for the alternating current is a basic condition, and the pressure-contact force for the direct current is set to 0.8 times the case of the alternating current. As a result, a preferable image formation can be performed.

In the above-described embodiments and variations, the color copier 1 is described as an example of an image forming apparatus, but the image forming apparatus is not limited thereto. The present disclosure is adoptable to a printer, a facsimile machine, other types of copier, and an MFP. In the above-described embodiments and variations, the transfer sheet S is mentioned as an example of the recording medium on which an image is formed, and is not limited the standard paper but also includes thick paper, a postcard, an envelope, plain paper, thin paper, coated paper, art paper, tracing paper, an overhead projector transparency (OHP sheet or OHP film), a resin film, and any other sheet-shaped material on which an image can be formed.

The above-described embodiments are illustrative and do not limit the present disclosure. Thus, numerous additional modifications and variations are possible in light of the above teachings, unless otherwise specified. The advantages achieved by the embodiments described above are examples and therefore are not limited to those described above. For example, elements and/or features of different illustrative embodiments may be combined with each other and/or substituted for each other within the scope of the present disclosure.

What is claimed is:

1. A transfer device comprising:

an intermediate transfer belt configured to bear a toner image and rotate, the intermediate transfer belt being shaped as an endless belt;

a transferor configured to contact the intermediate transfer belt via a recording medium and form a transfer nip;

a guide configured to guide the recording medium conveyed to the transfer nip; and a pressure reducing device configured to reduce pressure-contact force of the transferor against the intermediate transfer belt as the recording medium advances in the transfer nip, wherein a transfer bias in the transfer nip is a direct current or an alternating current, and wherein an amount of pressure reduction by the pressure reducing device is adjustable for each of the direct current and the alternating current.

2. The transfer device of claim 1, wherein the pressure reducing device is configured to vary the amount of the pressure reduction according to a type of the recording medium.

3. An image forming apparatus comprising the transfer device of claim 1.

4. The transfer device of claim 1, wherein the transferor includes a pair of opposed rollers, the intermediate transfer belt being contactable between the pair of opposed rollers in the transfer nip.

5. The transfer device of claim 4, wherein cams of at least one of the pair of opposed rollers includes a relatively small radius portion and a relatively large radius portion, and wherein a degree of pressure-contact between the pair of opposed rollers varies with rotation angle of the cams.

6. The transfer device of claim 1, wherein a roller is included to push the intermediate transfer belt in a direction towards a roller of the transferor, to form a secondary nip at a position upstream from the transfer nip, and wherein the pressure reducing device is configured to reduce pressure-contact force of the transferor against the intermediate transfer belt after the recording medium has entered the secondary nip.

7. A transfer device comprising:

an intermediate transfer belt configured to bear a toner image and rotate, the intermediate transfer belt being shaped as an endless belt;

a transferor configured to contact the intermediate transfer belt via a recording medium and form a transfer nip;

a guide configured to guide the recording medium conveyed to the transfer nip; and a pressure reducing device configured to reduce pressure-contact force of the transferor against the intermediate transfer belt as the recording medium advances in the transfer nip, wherein an amount of pressure reduction by the pressure reducing device is adjustable in multiple stages.

8. The transfer device of claim 7, wherein a transfer bias in the transfer nip is a direct current or an alternating current, and the amount of the pressure reduction is adjustable for each of the direct current and the alternating current.

9. The transfer device of claim 8, wherein the pressure reducing device is configured to vary the amount of the pressure reduction according to a type of the recording medium.

10. The transfer device of claim 8, wherein the transferor includes a pair of opposed rollers, the intermediate transfer belt being contactable between the pair of opposed rollers in the transfer nip.

11. The transfer device of claim 10, wherein cams of at least one of the pair of opposed rollers includes a relatively small radius portion and a relatively large radius portion, and wherein a degree of pressure-contact between the pair of opposed rollers varies with rotation angle of the cams.

12. An image forming apparatus comprising the transfer device of claim 7.

13. The transfer device of claim 7, wherein a roller is included to push the intermediate transfer belt in a direction towards a roller of the transferor, to form a secondary nip at a position upstream from the transfer nip, and wherein the pressure reducing device is configured to reduce pressure-contact force of the transferor against the intermediate transfer belt after the recording medium has entered the secondary nip.

* * * * *